United States Patent [19]

Isozumi

[11] Patent Number: 4,985,637

[45] Date of Patent: Jan. 15, 1991

[54] SUPPORT BEARING FOR COAXIAL STARTER

[75] Inventor: Shuzoo Isozumi, Hyogo, Japan

[73] Assignee: Mitsubishi Denki Kabushiki Kaisha, Tokyo, Japan

[21] Appl. No.: 344,740

[22] Filed: Apr. 28, 1989

[30] Foreign Application Priority Data

Jun. 8, 1988 [JP] Japan ..... 63-75924

[51] Int. Cl.[5] ..... F02N 11/02

[52] U.S. Cl. ..... 290/48; 74/7 R

[58] Field of Search ..... 74/6, 7 A, 7 B, 7 R; 290/48; 310/90

[56] References Cited

U.S. PATENT DOCUMENTS

| | | | |
|---|---|---|---|
| 3,791,685 | 2/1974 | Hamman | 290/38 |
| 4,326,429 | 4/1982 | Mortensen | 74/7 R |
| 4,613,761 | 9/1986 | Yabunaka | 290/36 R |
| 4,760,274 | 7/1988 | Isozumi | 290/48 |

FOREIGN PATENT DOCUMENTS

| | | | |
|---|---|---|---|
| 0154543 | 9/1985 | European Pat. Off. | 310/90 |
| 1311876 | 11/1962 | France . | |
| 1343506 | 10/1987 | U.S.S.R. | 310/90 |

*Primary Examiner*—A. D. Pellinen
*Assistant Examiner*—Robert L. Hoover
*Attorney, Agent, or Firm*—Sughrue, Mion, Zinn, Macpeak & Seas

[57] ABSTRACT

A coaxial starter comprising an electric motor having an armature shaft which is a tubular shaft, an output rotary shaft slidable in the axial direction thereof extends at one end of the motor so that the torque of the armature shaft is transmitted to the output rotary shaft through a driving power transmission means. A pinion is provided on the output rotary shaft at the end of the coaxial starter. An electromagnetic switch provided at the other end of the motor has an actuator rod extending into the internal opening of the armature shaft through the opening of the wall of the motor so that the rod is moved in the axial direction of the motor at the time of electric energizing of the switch. This slides the output rotary shaft in the axial direction of the motor. The coaxial starter further comprises a bearing fitted in the opening of the wall and supporting the armature shaft and the rod.

4 Claims, 3 Drawing Sheets

SUPPORT BEARING FOR COAXIAL STARTER

BACKGROUND OF THE INVENTION

The present invention relates to a coaxial starter, particularly to a coaxial starter for starting the engine of a vehicle.

FIG. 3 shows a conventional starter 1 for starting the engine of a vehicle. The starter 1 comprises a DC motor 2; an overrunning clutch 4 slidably fitted on an output rotary shaft 3; a planet gear mechanism 5 for transmitting the torque of the armature shaft 2*a* of the DC motor to the outer member 4*a* of the overrunning clutch through the output rotary shaft so that the rotation speed of the outer member is lower than that of the armature shaft; and a shift lever 8 which is engaged at one end thereof with the actuation rod of an electromagnetic switch 6 provided at the peripheral portion of the DC motor in order to slide the overrunning clutch on the output rotary shaft and is engaged at the other end thereof with an annular member 7 attached to the overrunning clutch. Since the electromagnetic switch 6 for applying electric power to the DC motor 2 is disposed at the peripheral portion of the motor, the starter 1 is of the two-axis type. For that reason, the layout of the engine in the vehicle is greatly restricted. This is a problem.

In order to solve the problem, a starter having an electromagnetic switch disposed at one end of a DC motor to shape the starter as a simple slender cylinder, was proposed. The armature shaft of the DC motor is hollow. The actuation rod of the electromagnetic switch, which would actuate the shift lever in the starter shown in FIG 3, is moved toward an output rotary shaft through the internal opening of the armature shaft. Since the actuation rod is coaxial to the armature shaft, the starter is called a coaxial starter. Although the coaxial starter is shaped as the simple slender cylinder, the actuation rod extending from the body of the electromagnetic switch into the internal opening of the armature shaft is likely to incline so that the end of the rod moved toward the output rotary shaft does not horizontally push the output rotary shaft at the end thereof through the action of a ball but causes the output rotary shaft to fail to properly slide. This is a problem. Since the electromagnetic switch is disposed behind the DC motor and the actuation rod extends from the body of the switch into the internal opening of the armature shaft through the opening of the wall of the motor, dust or chips generated as a result of the wear of the brushes of the motor are likely to enter into the contact chamber of the switch to cause the contacts thereof to fail to come into proper touch with each other. This is another problem.

SUMMARY OF THE INVENTION

The present invention was made in order to solve the above-mentioned problems.

Accordingly, it is an object of the present invention to provide a coaxial starter in which the actuation rod of an electromagnetic switch does not incline and dust or chips in an electric motor do not enter into the switch. The starter comprises the electric motor having an armature shaft which is a tubular shaft; an output rotary shaft slidable in the axial direction thereof and extending at one end of the motor so that the torque of the armature shaft is transmitted to the output rotary shaft through a driving power transmission means; a pinion provided on the output rotary shaft at the end thereof; the electromagnetic switch provided at the other end of the motor and having the actuation rod extending into the internal opening of the armature shaft through the opening of the wall of the motor so that the rod is moved in the axial direction thereof at the time of electric energizing of the switch so as to slide the output rotary shaft in the axial direction thereof; and a bearing fitted in the opening of the wall and supporting the armature shaft and the rod.

When the electromagnetic switch is electrically energized, the actuation rod is moved in the axial direction thereof to push out the output rotary shaft and the contacts of the switch are put into touch with each other to apply electric power to the motor. As a result, the torque of the armature shaft of the motor is transmitted to the output rotary shaft through the driving power transmission means so that the pinion is rotated to start an engine. At that time, since the actuation rod extending from the body of the electromagnetic switch into the internal opening of the armature shaft through the opening of the wall of the motor is supported by the bearing fitted in the opening of the wall, the rod does not incline and therefore properly acts to apply a pushing force to the output rotary shaft to appropriately slide it in the axial direction thereof. Besides, since the opening of the wall is tightly closed with the bearing, the dust or chips do not pass through the opening. Therefore the contacts of the electromagnetic switch do not come into improper touch with each other due to the dust or chips.

DETAILED DESCRIPTION OF EXEMPLARY EMBODIMENTS

Embodiments of the present invention are hereafter described in detail with reference to the drawings attached hereto.

Figure 1:
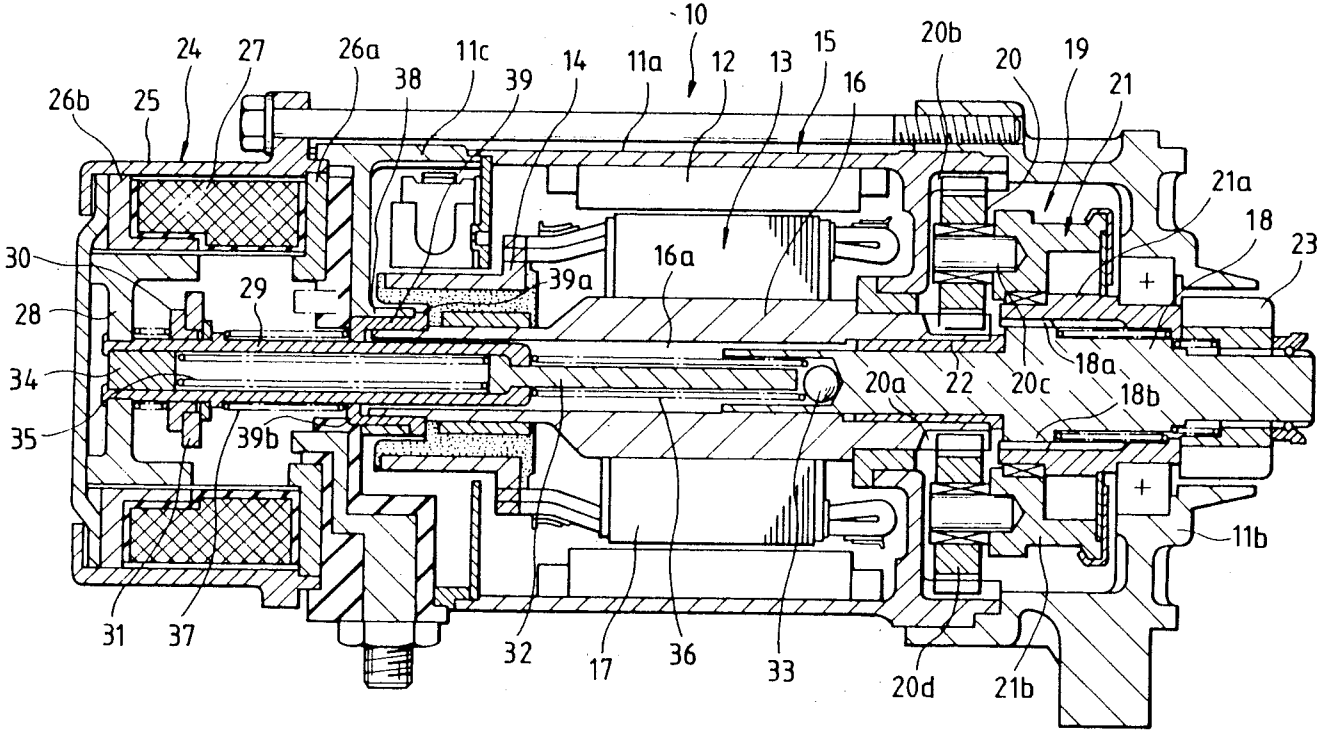
FIG. 1 shows a longitudinally sectional view of a coaxial starter which is an embodiment of the present invention.

FIG. 1 shows a coaxial starter 10 which is one of the embodiments and is for starting the engine of a vehicle. The starter 10 comprises a front cover 11*b*, a rear cover 11*c*, a DC motor 15, an output rotary shaft 18, a driving power transmission means 19, a pinion 23, and an electromagnetic switch 24.

The DC motor 15 includes a yoke 11*a* which constitutes the cover of the motor and serves to form a magnetic circuit, permanent magnets 12 secured to the inside circumferential surface of the yoke and disposed at intervals in the circumferential direction of the yoke, an armature 13 rotatably supported around the axis of the yoke, and a conventional commutator 14 provided at one end of the armature. The armature 13 includes a hollow armature shaft 16, and an armature core 17 mounted on the outside circumferential surface of the shaft.

The output rotary shaft 18 is provided near the front end (which is the right-hand end as to FIG. 1) of the DC motor 15 coaxially to the armature shaft 16 thereof. The torque of the motor 15 is transmitted to the output rotary shaft 18 through the driving power transmission means 19. The output rotary shaft 18 is inserted at one end thereof in the internal opening 16a of the armature shaft 16 and supported by a sleeve bearing 22 provided between the inside circumferential surface of the armature shaft and the outside circumferential surface of the output rotary shaft, so that the output rotary shaft is slidable in the axial direction thereof.

The driving power transmission means 19 includes a speed reduction planet gear mechanism 20 a one-way clutch 21, which is an overrunning clutch, and helical splines 18a formed on the output rotary shaft 18 and engaged with the inner member 21a of the clutch. The turning force of the armature shaft 16 is transmitted to the output rotary shaft 18 through the speed reduction planet gear mechanism 20 and the one-way clutch 21.

The speed reduction planet gear mechanism 20 includes a sun gear 20a integrally formed on the outside circumferential surface of the armature shaft 16 at one end thereof, an internal gear 20b formed on the inside circumferential surface of the yoke 11a of the DC motor 15 coaxially to the sun gear, and a plurality of planet gears 20d engaged with the sun gear and the internal gear and rotatably supported by center shafts 20c secured to the outer member 21b of the one-way clutch 21.

Since the inner member 21a of the clutch 21 is engaged with the helical splines 18a formed on the outside circumferential surface of the radially outward projection 18b of the output rotary shaft 18, the shaft is slid in the axial direction thereof while receiving the torque of the inner member, so that the pinion 23 mounted on the shaft at the front end thereof is moved out from the front cover 11b and engaged with the ring gear of the engine to star it.

The electromagnetic switch 24 is provided behind the rear cover 11c fitted to the rear end of the DC motor 15, so that the switch acts to slide the output rotary shaft 18 and apply electric power from a battery to the DC motor when the ignition switch of the vehicle is turned on. The switch 24 includes a Case 25, a front and a rear cores 26a and 26b for constituting a magnetism passage in cooperation with the case, an electromagnetic coil 27 wound on a plastic bobbin supported by the cores, an actuator 28 slidably supported in the internal opening of the bobbin, a tubular actuation rod 29 which is made of a nonmagnetic stainless steel and attached at the rear end thereof to the actuator and extends forward into the internal opening 16a of the armature shaft 16 through the opening of the wall of the rear cover 11c and the rear end of the armature shaft so that the front end of the rod is located in the internal opening, and a movable contact 31 attached with an interposed electric insulator 30 to the rod. A push bar 32 is slidably fitted in the tubular actuation rod 29 and extends forward from the vicinity of the front open end of the actuation rod so that the front end of the push bar is located in contact with a steel ball 33 provided in the blind hole of the output rotary shaft 18 and placed on the innermost wall in the blind hole. The rear end of the tubular actuation rod 29 is closed with a plug 34. A coil spring 35 is provided in the rod 29 so that the ends of the spring are in contact with the plug 34 and the rear end of the push bar 32, respectively. When the tubular rod 29 is moved forward, the spring 35 acts to apply a pushing force to the push bar 32 to thrust the output rotary shaft 18. Since the coil spring 35 of relatively large length is provided in the tubular actuation rod 29, the appropriate pushing force is applied to the push bar 32 with the appropriate stress of the spring. A coil spring 36 is provided in the armature shaft 16 to keep the steel ball 33 in a prescribed position. A return spring 37 is provided around the tubular rod 29 to move it backward.

The opening of the wall of the rear cover 11c, through which the tubular rod 29 extends near the DC motor 15, is defined by a rear cover portion 38 bent inward from the wall toward the motor. A cylindrical bearing 39 is fitted in the opening. The small-diameter portion of the armature shaft 16 near the rear and thereof is fitted in the bearing 39 so that the shaft is supported. The bearing 39 has a front portion 39a projecting outward in the radial direction of the bearing along the front end of the cover portion 38 and located at the front end of the front portion with the wall of the stepped part of the small-diameter portion of the armature shaft 16 and with the commutator 14 so as to receive a force in the axial direction of the starter. The bearing 39 has a rear portion 39b projecting inward in the radial direction of the bearing so that the tubular rod 29 extending into the internal opening 16a of the armature shaft 16 through the bearing is slidably supported by the rear portion thereof. Since the rod 29 is thus supported nearly at the middle portion thereof by the bearing 39, the rod does not incline and therefore properly acts to slide the output rotary shaft 18.

Since the tubular rod 29 is supported by the radially-projecting rear portion of the bearing 39 with no clearance between them in the opening of the wall of the rear cover 11c, dust or chips generated as a result of the wear of the brushes of the DC motor 15 do not enter into the electromagnetic switch 24 through the opening. Therefore, the contacts of the switch 24 do not come into improper touch with each other due to the dust or chips.

Figure 2:
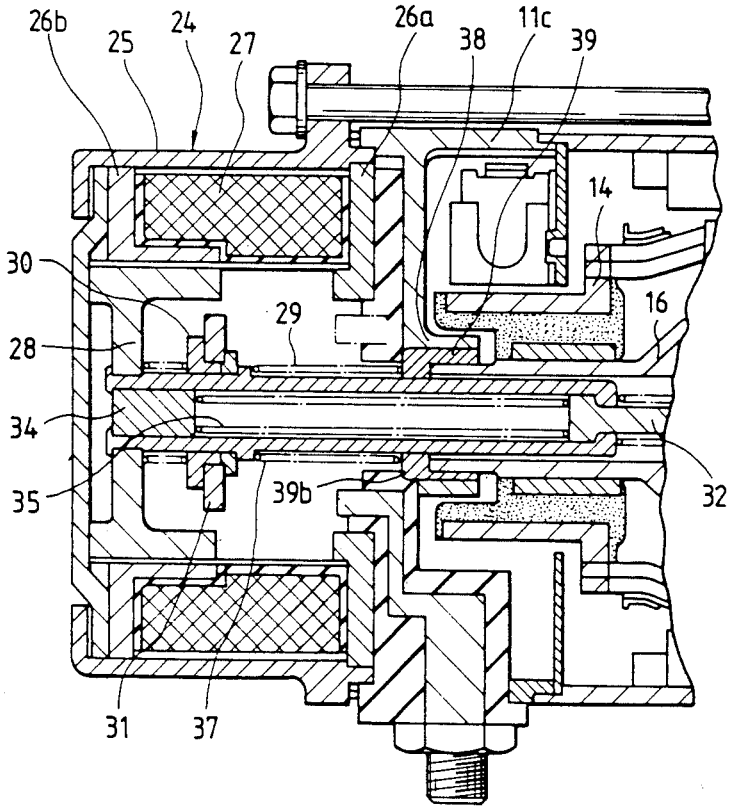
FIG. 2 shows a longitudinally sectional view of a major part of a coaxial starter which is another embodiment of the present invention.
Figure 3:
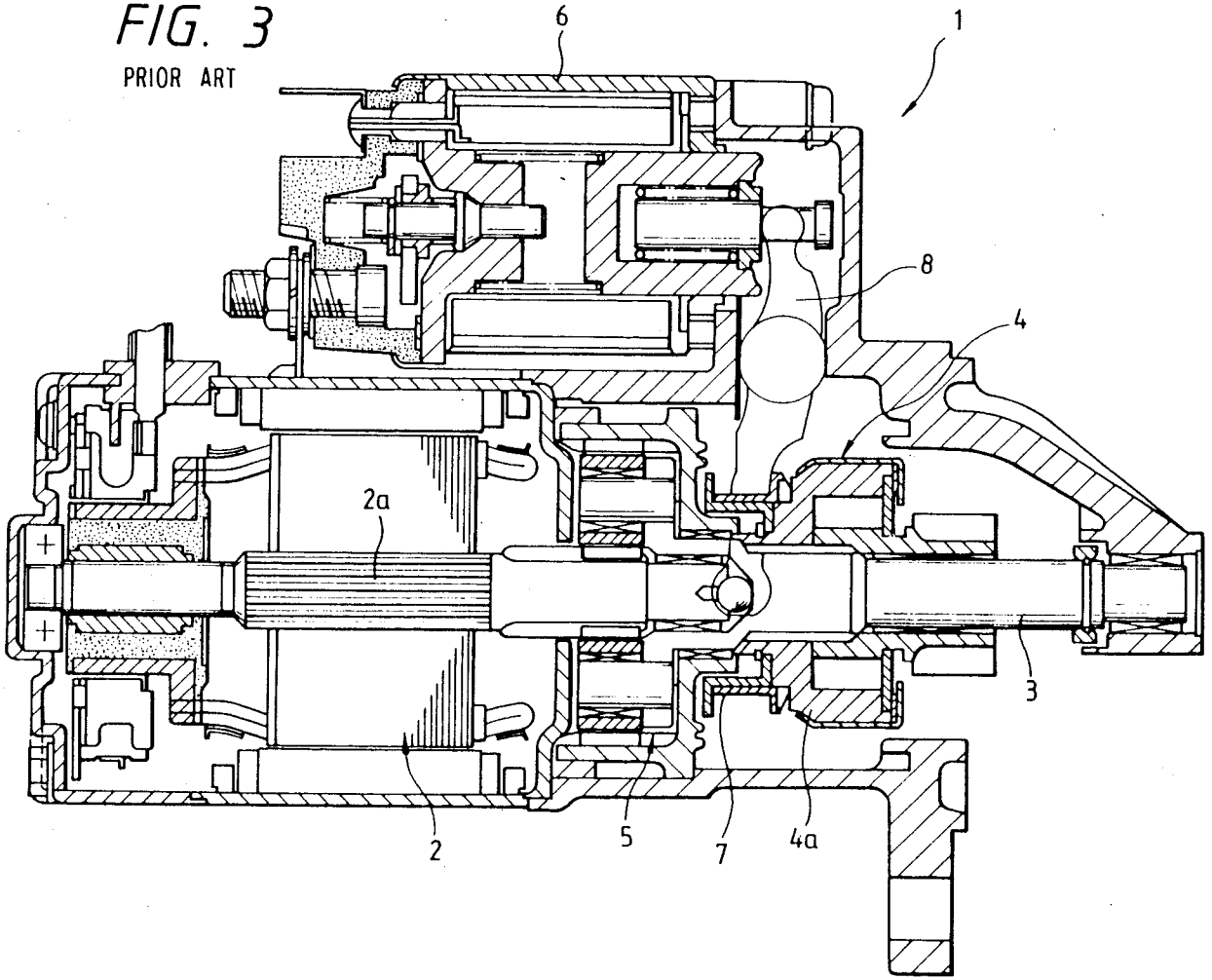
FIG. 3 PRIOR ART
FIG. 3 shows a longitudinally sectional view of a conventional starter.

FIG. 2 shows a major part of a coaxial starter which is the other one of the embodiments and is for starting the engine of a vehicle. The difference of the starter from that shown in FIG. 1 is that the front of the radially-projecting rear portion 39b of a bearing 39 is located on the rear end of an armature shaft 16 to bear the thrust of the shaft. For that reason, the bearing 39 does not need to have a radially-projecting front portion as the bearing 39 of the starter shown in FIG. 1 does. Therefore, the form of the bearing 39 of the starter shown in FIG. 2 is simplified.

The present invention is not confined to the above-described embodiments, but may be practiced or embodied in other various ways without departing from the spirit or essential character thereof. For example coils and cores around which the coils are wound may be provided instead of the permanent magnets 12. Besides, the present invention may be embodied as a coaxial starter not having a speed reduction planet gear mechanism.

What is claimed is:

1. A coaxial starter comprising:

an electric motor having a wall and an armature shaft which is a tubular shaft defining an axial direction;

an output rotary shaft slidable in said axial direction and having an end portion extending at one end of said motor so that the torque of said armature shaft is transmitted to said output rotary shaft through a driving power transmission means;

a pinion provided on said output rotary shaft at said end portion thereof;

an electromagnetic switch provided at the other end of said motor adjacent said wall and having an actuation rod extending into the internal opening of said armature shaft through an opening of said wall of said motor so that said rod is moved in said axial direction at the time of electric energizing of said switch so as to slide said output rotary shaft in said axial direction; and bearing means for supporting both rotation of said armature shaft and axial movement of said rod, said bearing means being fitted in said opening of said wall.

2. A coaxial starter according to claim 1 wherein said bearing means has a front portion projecting outward in the radial direction of said bearing means and receiving a force in said axial direction.

3. A coaxial starter according to claim 1 wherein said bearing means has a rear portion projecting inward in the radial direction of said bearing means and slidably supporting said rod.

4. A coaxial starter according to claim 3 wherein said rear portion of said bearing means is located on the rear end of said armature shaft to bear the thrust of said shaft.

* * * * *